US008875823B2

(12) United States Patent
Lauper, Jr. et al.

(10) Patent No.: US 8,875,823 B2
(45) Date of Patent: Nov. 4, 2014

(54) MULTI-FUNCTIONAL COOLING SYSTEM

(75) Inventors: John C. Lauper, Jr., Cuba City, WI (US); Scott W. Zimmerman, Peosta, IA (US); Anthony Jon Knepper, Asbury, IA (US); Steven Richard Sass, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 13/549,008

(22) Filed: Jul. 13, 2012

(65) Prior Publication Data

US 2014/0014426 A1 Jan. 16, 2014

(51) Int. Cl.
*B60K 11/06* (2006.01)

(52) U.S. Cl.
USPC ..... 180/68.1; 180/68.5

(58) Field of Classification Search
USPC ..... 180/68.1, 68.2, 68.4, 68.5
See application file for complete search history.

(56) References Cited

U.S. PATENT DOCUMENTS

| | | | | |
|---|---|---|---|---|
| 3,404,732 | A * | 10/1968 | Mork | 165/51 |
| 5,490,572 | A * | 2/1996 | Tajiri et al. | 180/65.1 |
| 6,129,056 | A | 10/2000 | Skeel et al. | |
| 6,871,697 | B2 * | 3/2005 | Albright et al. | 165/51 |
| 7,134,518 | B2 * | 11/2006 | Arai et al. | 180/68.1 |
| 8,037,963 | B2 * | 10/2011 | Nishimura et al. | 180/291 |
| 8,230,957 | B2 * | 7/2012 | Braun et al. | 180/68.1 |
| 8,317,889 | B2 * | 11/2012 | Kobayashi et al. | 55/385.3 |
| 2002/0104239 | A1 | 8/2002 | Naruse et al. | |
| 2004/0098983 | A1 | 5/2004 | Naruse et al. | |
| 2007/0007061 | A1 * | 1/2007 | Meyer et al. | 180/68.1 |
| 2010/0181127 | A1 * | 7/2010 | Braun | 180/68.1 |
| 2012/0285757 | A1 * | 11/2012 | Atarashi et al. | 180/68.1 |

FOREIGN PATENT DOCUMENTS

| | | | |
|---|---|---|---|
| EP | 0727529 | A1 | 8/1996 |
| EP | 1091048 | A2 | 4/2001 |
| WO | WO2011/158618 | A1 | 12/2011 |

OTHER PUBLICATIONS

Search Report dated Oct. 4, 2013 in related European Patent Application No. 13176334.4.

Brochure, *G/GP-Series Graders*, John Deere, 40 pages, available at http://www.deere.com/en_US/docs/construction/motor_graders/DKAGGDR.pdf, accessed on Jul. 6, 2013.

* cited by examiner

*Primary Examiner* — John Walters
*Assistant Examiner* — Brian Swenson
(74) *Attorney, Agent, or Firm* — Faegre Baker Daniels LLP

(57) ABSTRACT

A vehicle includes a chassis; a plurality of ground-engaging members; and an engine that cooperates with the plurality of ground-engaging members to move the chassis of the vehicle. The engine is positioned within an engine compartment. The vehicle further includes a cooling system including a baffle having a first side and a second side; a battery positioned on the first side of the baffle; and a heat exchanger positioned on the second side of the baffle. The baffle defines a first air pathway to cool the battery and a second air pathway to cool the heat exchanger.

23 Claims, 15 Drawing Sheets

MULTI-FUNCTIONAL COOLING SYSTEM

FIELD OF THE INVENTION

The present disclosure relates generally to a vehicle having a cooling system and, more particularly, to a vehicle including a multi-functional cooling system.

BACKGROUND OF THE INVENTION

Typically, engine systems for both highway and off-highway vehicles include a cooling unit, or heat exchanger, capable of cooling the engine cooling fluid (e.g., coolant), transmission oil, engine oil, etc. Cooling units may be positioned under the hood or within the engine compartment of the vehicle. However, cooling units for off-highway vehicles may be large and difficult to package under the hood or in the engine compartment without obstructing the operator's line of sight. Additionally, heat in the engine compartment may risk damage to temperature-sensitive components within or near the engine compartment. For off-highway vehicles, the cooling system may include multiple cooling units in a compact configuration in order to minimize any impact on the size and weight of the vehicle.

SUMMARY

An exemplary embodiment of the present disclosure includes a vehicle includes a chassis; a plurality of ground-engaging members; and an engine that cooperates with the plurality of ground-engaging members to move the chassis of the vehicle. The engine is positioned within an engine compartment. The vehicle further includes a cooling system including a baffle having a first side and a second side; a battery positioned on the first side of the baffle; and a heat exchanger positioned on the second side of the baffle. The baffle defines a first air pathway to cool the battery and a second air pathway to cool the heat exchanger.

Another exemplary embodiment of the present disclosure includes a vehicle having a chassis; a plurality of ground-engaging members; an engine cooperating with the plurality of ground-engaging members to move the chassis of the vehicle; and a cooling system.

The cooling system includes a fluid reservoir; and a baffle assembly generally positioned around the fluid reservoir and spaced apart from the fluid reservoir. An inner surface of the baffle assembly cooperates with an outer surface of the fluid reservoir to define a channel. The cooling system is configured to direct ambient air from outside the vehicle through the channel.

A further exemplary embodiment of the present disclosure includes a vehicle having a chassis; a plurality of ground-engaging members; an engine supported by the chassis and operatively coupled to the plurality of ground-engaging members to move the vehicle; and at least one battery spaced apart from the engine. The vehicle further includes a cooling system having a fluid reservoir; a baffle spaced apart from the fluid reservoir; a heat exchanger spaced apart from the baffle; and a fan spaced apart from the baffle. The cooling system is configured to direct a first flow of ambient air around the battery and along an inner surface of the baffle, and a second flow of ambient air around the heat exchanger and along an outer surface of the baffle.

Another exemplary embodiment of the present disclosure includes a vehicle having a chassis; a plurality of ground-engaging members; and an engine positioned within an engine compartment supported by the chassis and operatively coupled to the plurality of ground-engaging members. The vehicle also includes a battery compartment positioned within the engine compartment; and a cooling system positioned rearwardly of the engine. The cooling system includes a fluid reservoir; and a baffle assembly spaced apart from the fluid reservoir. The cooling system further includes a heat exchanger positioned laterally outward from the baffle assembly; and a fan configured to direct air from the battery compartment rearwardly through the baffle assembly.

Additional features and advantages of the present invention will become apparent to those skilled in the art upon consideration of the following detailed description of the illustrative embodiment exemplifying the best mode of carrying out the disclosure as presently perceived.

BRIEF DESCRIPTION OF THE DRAWINGS

The foregoing aspects and many of the intended advantages of this disclosure will become more readily appreciated as the same becomes better understood by reference to the following detailed description when taken in conjunction with the accompanying drawings.

Figure 1:
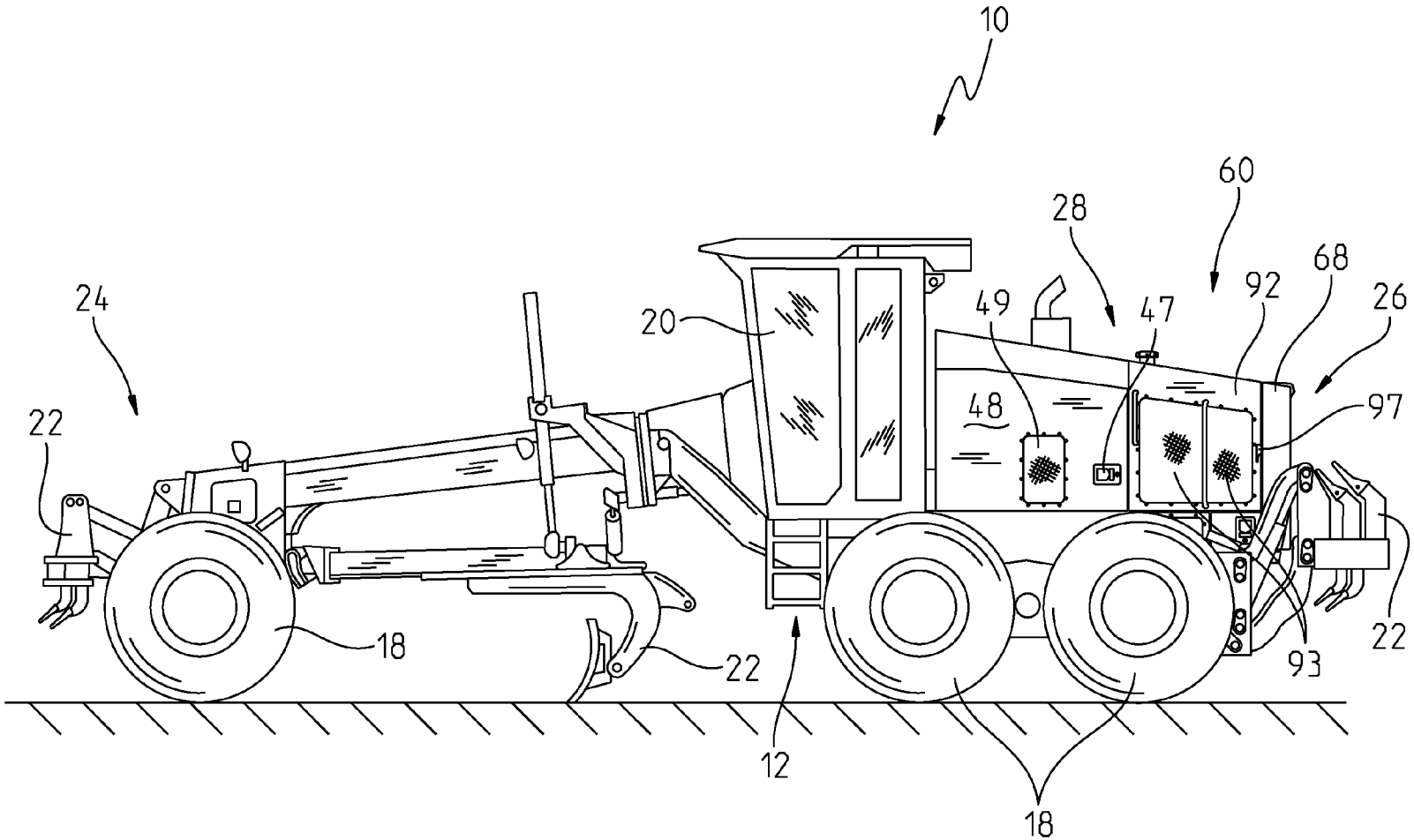
FIG. 1 is a left side view of an illustrative grader of the present disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION

For the purposes of promoting an understanding of the principals of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Figure 2:
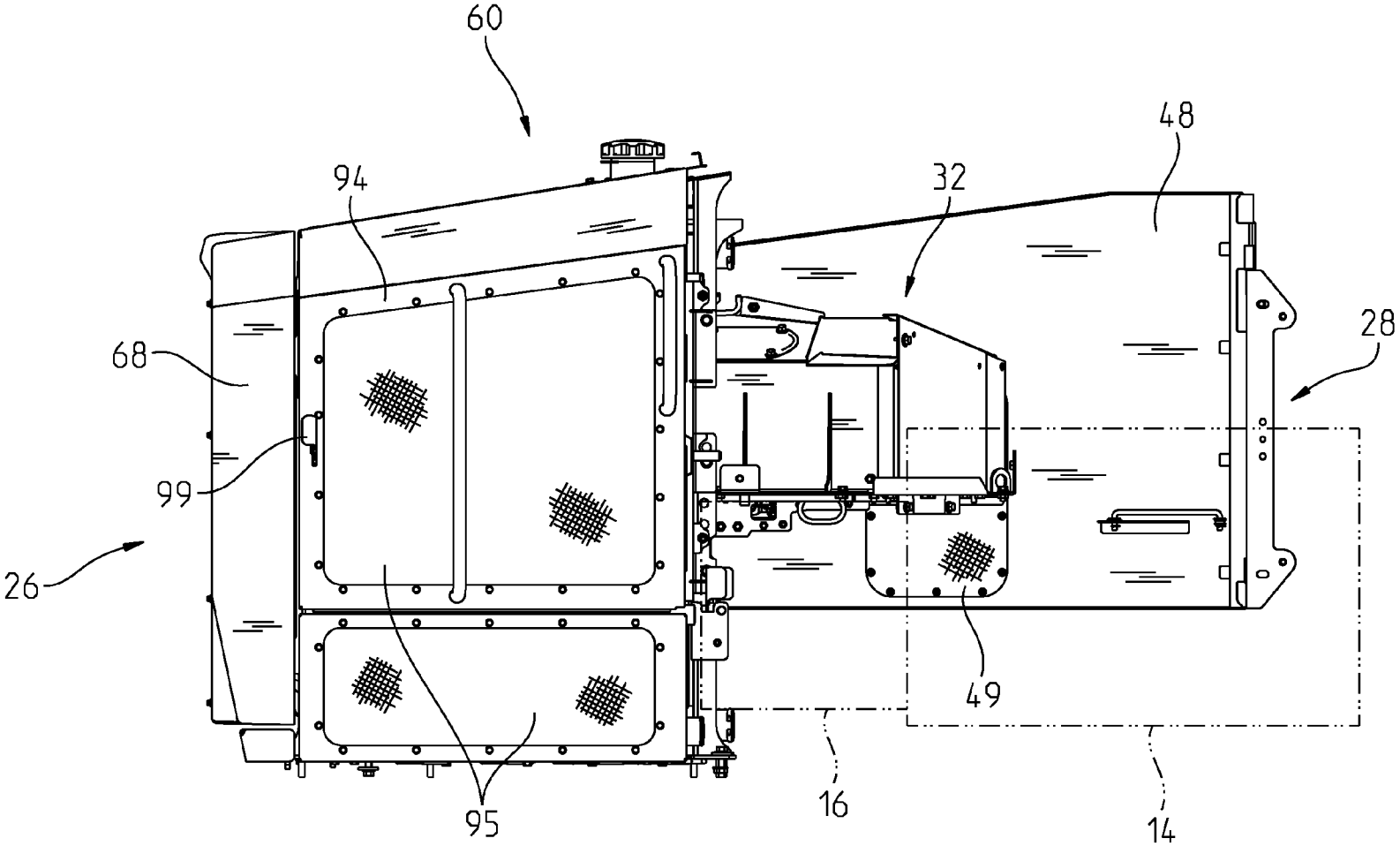
FIG. 2 is a right side view of an engine compartment and a cooling system of the grader of FIG. 1.

Referring to FIGS. 1 and 2, a construction, agricultural, or engineering vehicle is provided in the form of a grader 10. Although the vehicle is illustrated and described herein as grader 10, the vehicle may be in the form of a tractor, a bulldozer, a dump truck, an excavator, a crawler, or other agricultural or utility vehicle, for example. Grader 10 includes a chassis 12, an engine 14, a transmission 16, and a ground-engaging mechanism, illustratively, front and rear wheels 18. It is also within the scope of the present disclosure that the ground-engaging mechanism of grader 10 may include belts or tracks, for example. In use, engine 14 may be a combustion engine operatively coupled to transmission 16 and wheels 18 in order to propel grader 10 across the ground. In alternative embodiments, engine 14 may be an electric engine having an electric generator and at least one electric motor. For example, the electric generator, the electric motor, and engine 14 may be electrically operatively coupled to the ground-engaging mechanism to move grader 10. At least engine 14 and transmission 16 are housed within an engine compartment 28 at a rear end 26 of grader 10.

Grader 10 of FIG. 1 also includes an operator cab 20 supported by chassis 12 to house and protect the operator. Operator cab 20 is positioned between a front end 24 and rear end 26 of grader 10, and may include foot pedals, a steering wheel, joysticks, monitors, and other controls (not shown) for operating grader 10.

Referring to FIG. 1, the illustrative embodiment of grader 10 further includes at least one work tool 22 in the form of a blade, scarifier/ripper, and/or plow. Other vehicles contemplated in this disclosure may include suitable work tools, such as dump bodies, forks, tillers, and mowers. Work tools 22 may be moveably coupled to chassis 12. The operator may control the movement of work tools 22 using joysticks or other controls located within operator cab 20.

Figure 3:
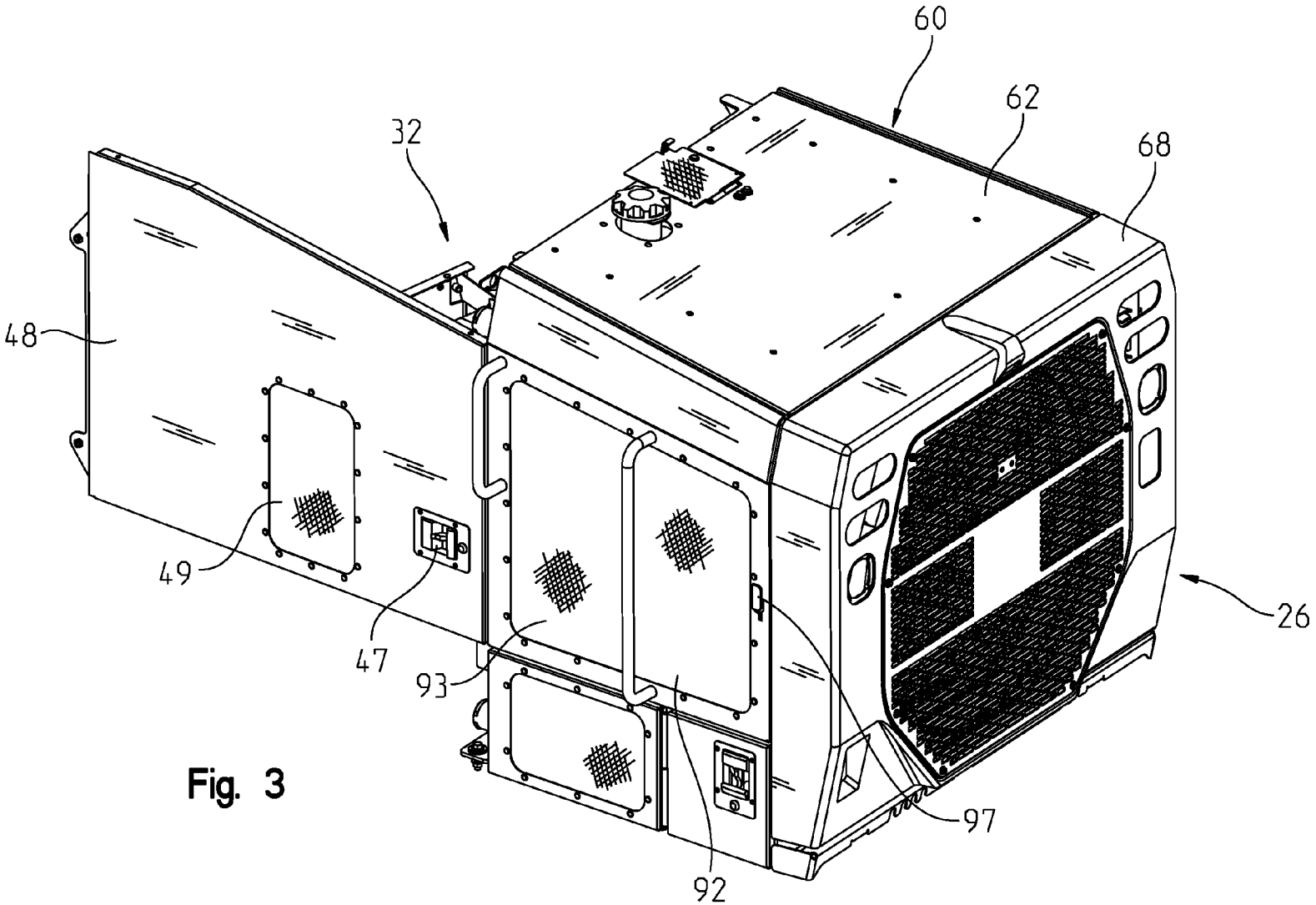
FIG. 3 is a left rear perspective view of the engine compartment and the cooling system of FIG. 2.
Figure 4:
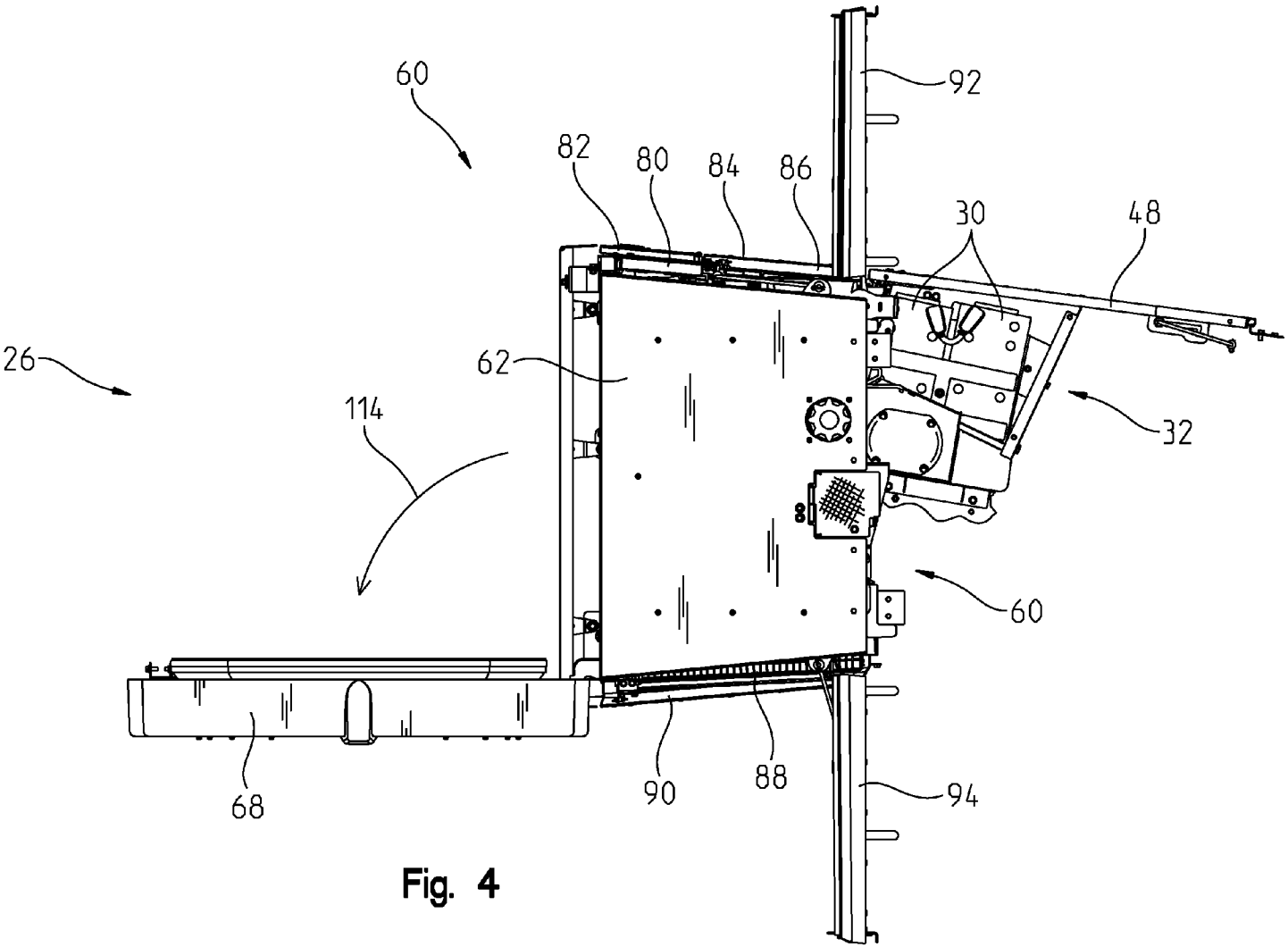
FIG. 4 is a top plan view of the cooling system and the engine compartment of FIG. 2, shown with a fan and a plurality of doors rotated to an open position.

FIG. 1 shows that engine compartment 28 is illustratively rearward of operator cab 20 and forward of a cooling system 60. Engine compartment 28 is supported by chassis 12 and is comprised of a plurality of support members forming a frame (not shown). Referring to FIGS. 2-4, engine compartment 28 also may support at least one battery 30 positioned within a battery compartment or housing 32, and other components of grader 10 (e.g., pumps, surge tanks) Illustratively, there are at least two batteries 30 positioned along a left side of grader 10, where "left" and "right" are taken from the perspective of the operator facing forward inside operator cab 20.

Figure 5:
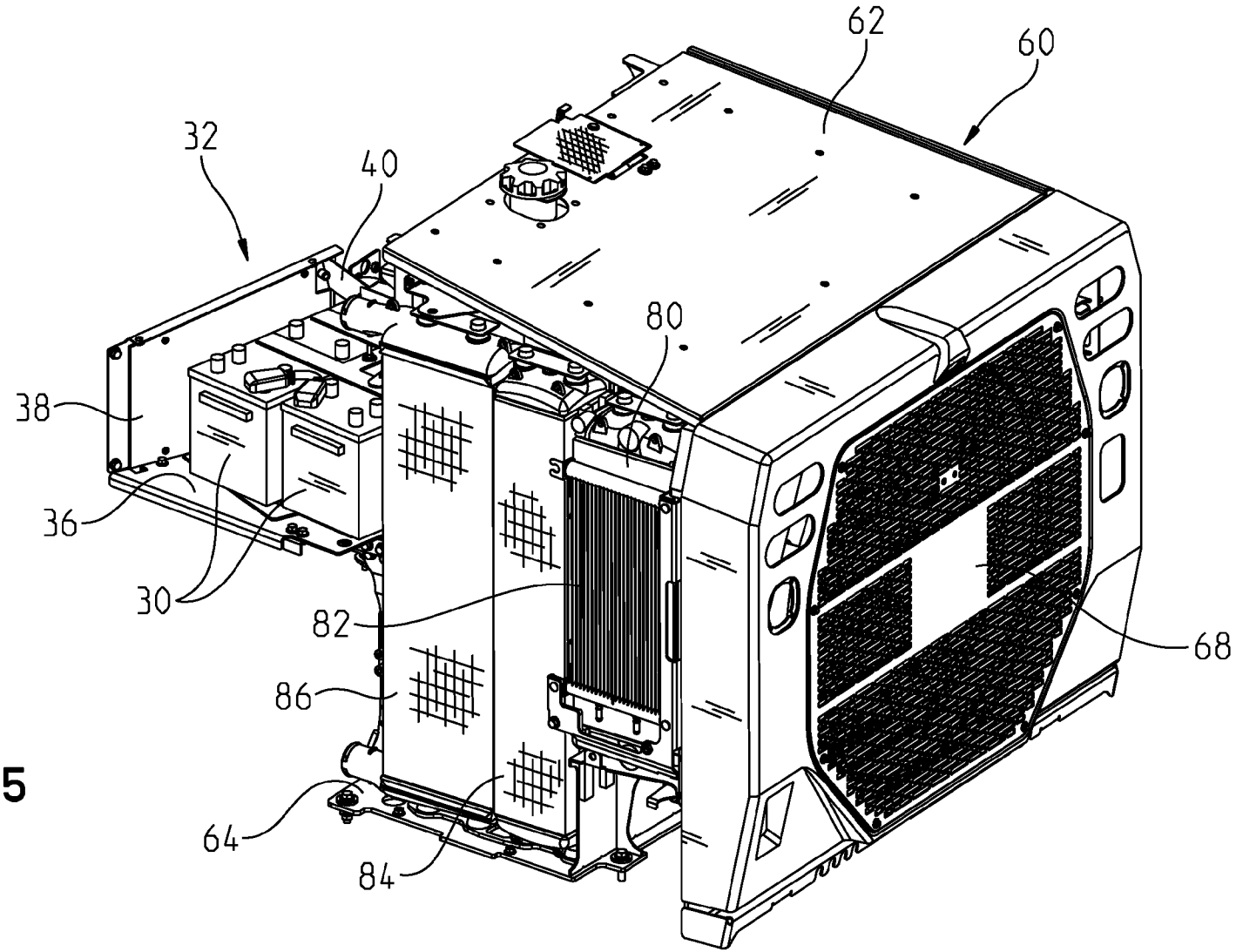
FIG. 5 is a left rear perspective view of the cooling system and the engine compartment of FIG. 2, shown with at least two doors removed to expose a plurality of batteries and heat exchangers.
Figure 7:
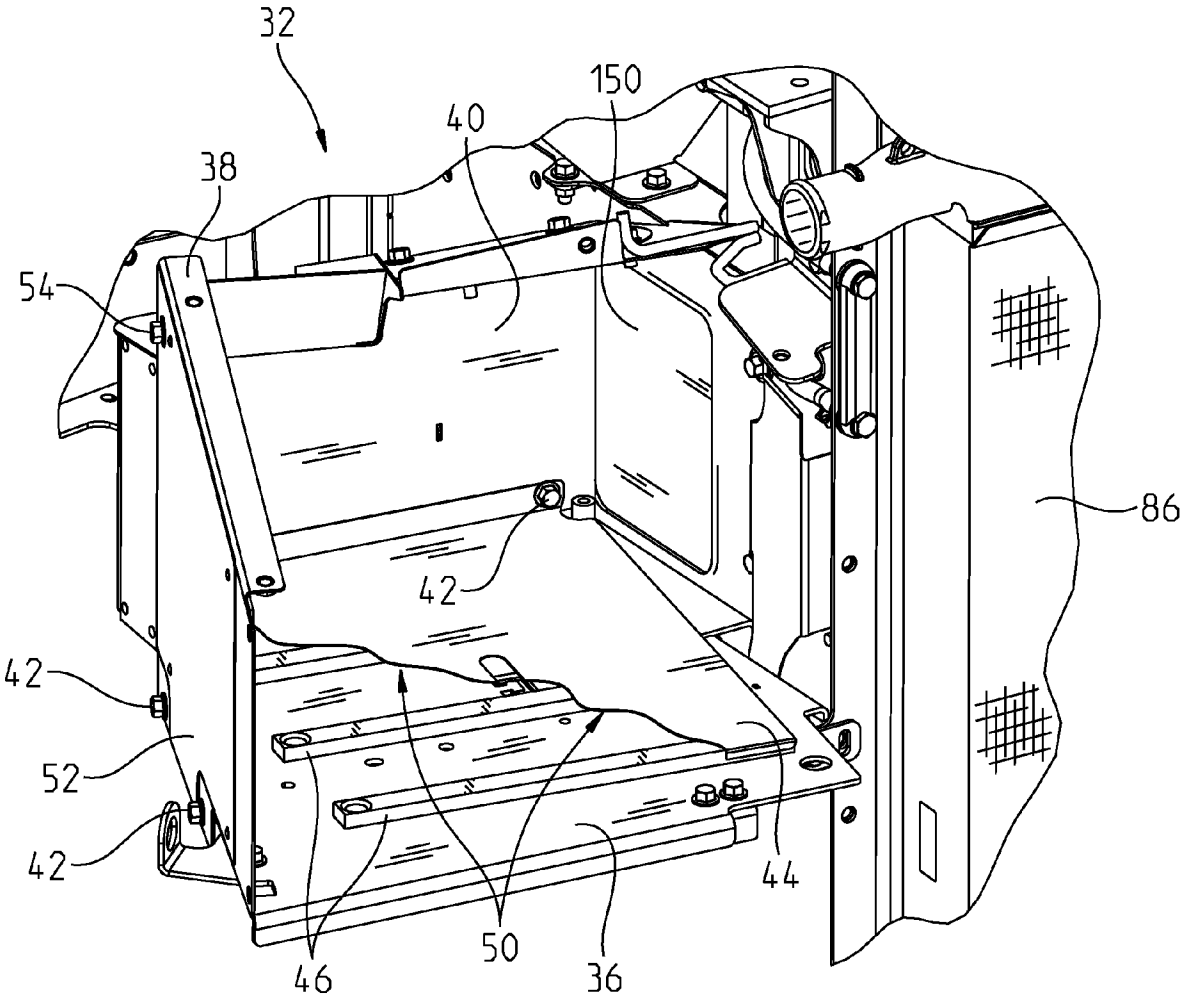
FIG. 7 is a front perspective view of the battery housing of FIG. 6, shown with the batteries removed.

As shown in FIGS. 5 and 7, batteries 30 are supported in engine compartment 28 by housing 32, which includes a lower wall 36, a front wall 38, and an inner wall 40. Illustratively, inner wall 40 is generally opposite door 48 (FIG. 4). Walls 36, 38, and 40 may be coupled together with conventional fasteners 42, for example bolts, screws, welds, or adhesive.

Figure 6:
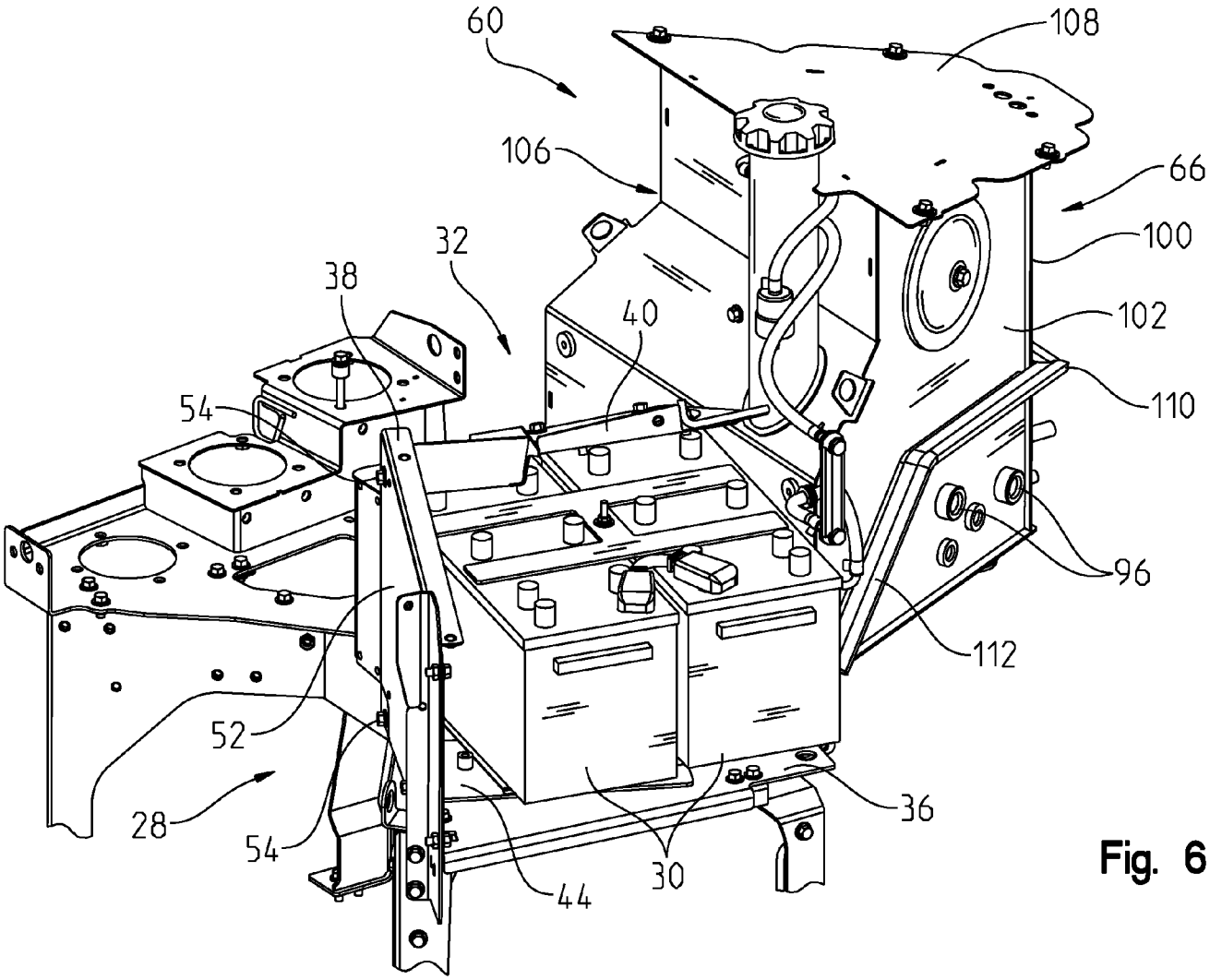
FIG. 6 is a front perspective view of the batteries of FIG. 5 positioned within a battery housing of the engine compartment, and a fluid reservoir of the cooling system.

As shown in FIGS. 5-7, housing 32 is coupled to cooling system 60 along the side generally opposite front wall 38, as is further detailed herein.

Within housing 32, batteries 30 may be supported on a tray or plate 44 atop lower wall 36. In some embodiments, batteries 30 may be secured to plate 44 with conventional fasteners (not shown). Plate 44 may be spaced apart from lower wall 36 by a plurality of inserts or spacers 46. The spaced relationship of plate 44 and lower wall 36 defines a channel 50 between batteries 30 and lower wall 36, and more particularly, between plate 44 and lower wall 36. Illustrative housing 32 of FIG. 7 includes at least four inserts 46 comprised of a generally non-conductive material, such as a polymeric material (e.g., nylon), to prevent conducting heat from engine compartment 28 to batteries 30. Inserts 46 prevent overheating batteries 30 by allowing air to flow below batteries 30 and by reducing the amount of heat transferred from engine compartment 28 to batteries 30 via lower wall 36.

Additionally, housing 32 generally shields batteries 30 from the heat in engine compartment 28. In particular, the temperature in engine compartment 28 outside of housing 32 may be greater than the temperature in housing 32 due to the heat generated by engine 14 and transmission 16. As shown in FIGS. 6 and 7, housing 32 may include a reflective plate or shield 52 to deflect radiant heat from engine 14 away from batteries 30 to prevent overheating batteries 30. Plate 52 may be coupled to side wall 38 with convention fasteners, illustratively bolts 54, and may be comprised of a reflective metallic material, for example stainless steel. In this manner, housing 32 forms a relatively cool chamber in engine compartment 28 for batteries 30.

Figure 14:
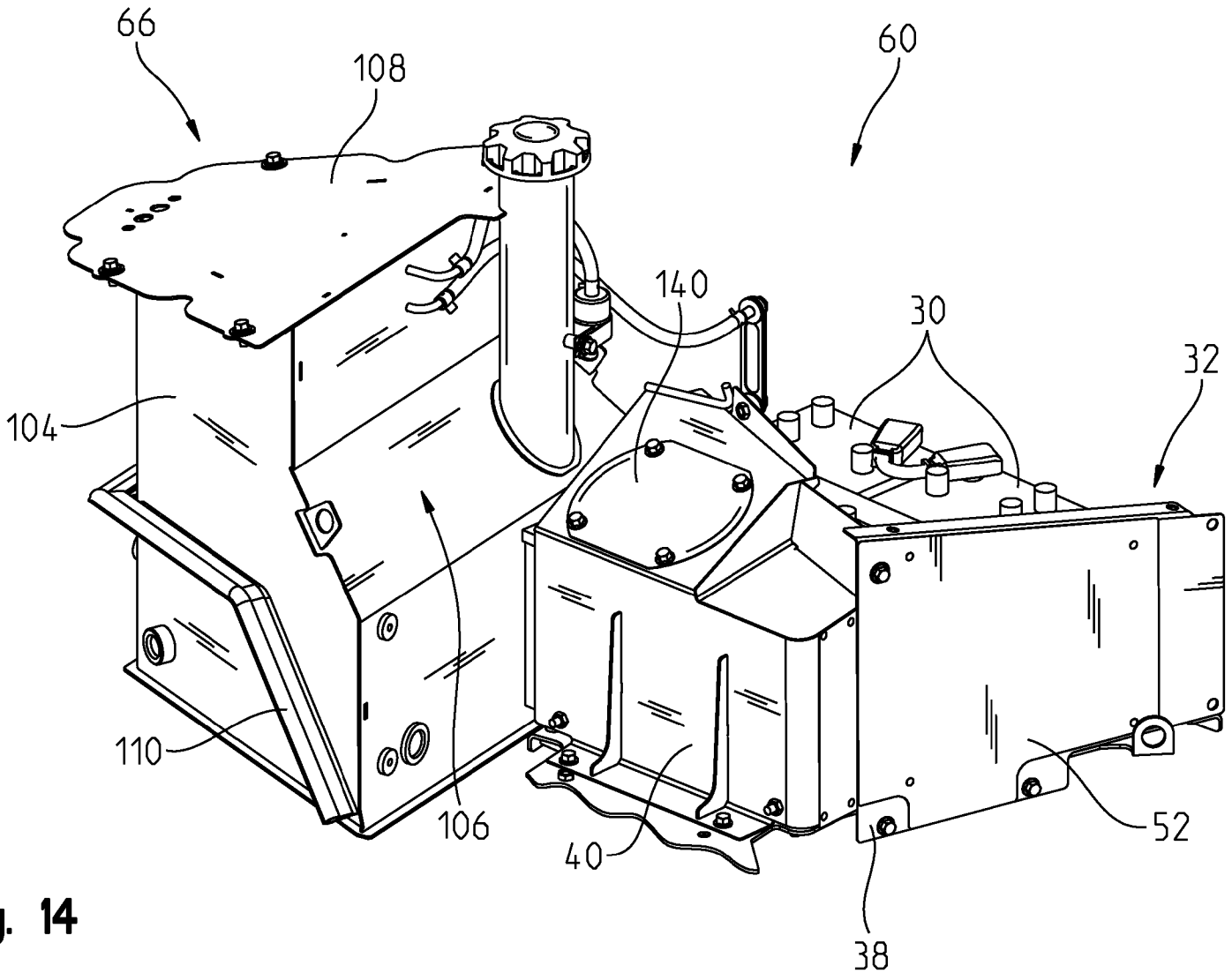
FIG. 14 is side perspective view of an alternative embodiment of the cooling system of the present disclosure, including a mounting portion for an electric fan for the battery housing of FIG. 6.

Alternative embodiments of cooling system 60 may include a mounting portion 140 for an electric fan (not shown) to further cool batteries 30. As shown in FIG. 14, mounting portion 140 is adjacent housing 32 and batteries 30, such that the electric fan mounted therein directs air flow to batteries 30, thereby further decreasing the operating temperature of batteries 30.

As shown in FIGS. 3 and 4, batteries 30 are covered by a door 48 during operation of grader 10. Door 48 may be latched with a latch assembly 47 in a closed position to cover batteries 30, however, latch assembly 47 may be unlatched in order to pivot door 48 to an open position when it is necessary to access batteries 30 and/or other components housed within engine compartment 28 for servicing or cleaning Door 48 includes a vent or screen 49 that transmits ambient air to batteries 30 in order to decrease the operating temperature of batteries 30. Screen 49 may also decrease the temperature of other components of grader 10, for example electrical components such as a DEF module and/or circuit breakers (not shown), which may be positioned below batteries 30 and lower wall 36 of housing 32. In addition to allowing cool ambient air to enter housing 32, screen 49 allows hot air in housing 32 and around the components below batteries 30 to flow out of grader 10.

Cooling system 60 is positioned rearward of engine 14 and decreases the temperature of vehicle fluids, such as transmission oil, hydraulic oil, turbo-charged air, axle oil, and/or cooling fluid (e.g., coolant). As such, cooling system 60 decreases the likelihood that heat generated by engine 14, transmission 16, and other components within engine compartment 28 will cause batteries 30, heat exchangers, a fluid reservoir 66, pumps, and/or surge tanks to overheat during operation of grader 10. Cooling system 60 also may be fluidly coupled to a plumbing system (not shown) that includes hoses, tubes, fluid lines, pipes, pumps, controls, monitors, and/or sensors for transporting fluids through grader 10.

As is further detailed herein, cooling system 60 is configured to draw ambient air from outside grader 10 into rear end 26, thereby introducing generally clean air into grader 10.

Compared to the ambient air at front end 24 of grader 10, the ambient air at rear end 26 of grader 10 may be less likely to contaminate cooling system 60 with particulate matter, dirt, and other debris. In the context of the present disclosure, ambient air is air that has not passed over or by engine 14.

Illustrative cooling system 60 has a compact configuration at rear end 26 of grader 10 and, therefore, does not obstruct the operator's line of sight from operator cab 20. Additionally, the compact configuration of cooling system 60 increases the space within engine compartment 28 that is available for other components of grader 10. For example, the emissions system (not shown) of grader 10 may be supported at rear end 26 and is arranged to comply with standard emissions requirements. In this way, cooling system 60 does not interfere with the space required for the emissions system or other components of grader 10.

Referring to FIGS. 4 and 5, cooling system 60 is shown including a frame having an upper support plate 62 and a lower support plate 64. Cooling system 60 further comprises a plurality of heat exchangers (which are discussed individually below), fluid reservoir 66, a fan 68, and a baffle or shroud assembly 70 (FIG. 9), as further detailed herein. The heat exchangers of cooling system 60 are vented with air passageways (not shown) for cooling the fluid transmitted therethrough.

As shown in FIG. 5, the illustrative embodiment of cooling system 60 includes a first heat exchanger 80, illustratively a transmission oil cooler or an axle oil cooler, a second heat exchanger 82, illustratively a fuel cooler, a third heat exchanger 84, illustratively a hydraulic oil cooler, and a fourth heat exchanger 86, illustratively a charge air cooler. Heat exchangers 80, 82, 84, and 86 are positioned rearward of batteries 30 and forward of fan 68 along the left side of cooling system 60. Heat exchangers 80, 82, 84, and 86 may be configured to rotate to facilitate cleaning and repair. Second heat exchanger 82 may be in a stacked arrangement with, and rotatably coupled to, first heat exchanger 80, such that second heat exchanger 82 may rotate or pivot away from first heat exchanger 80.

Figure 8:
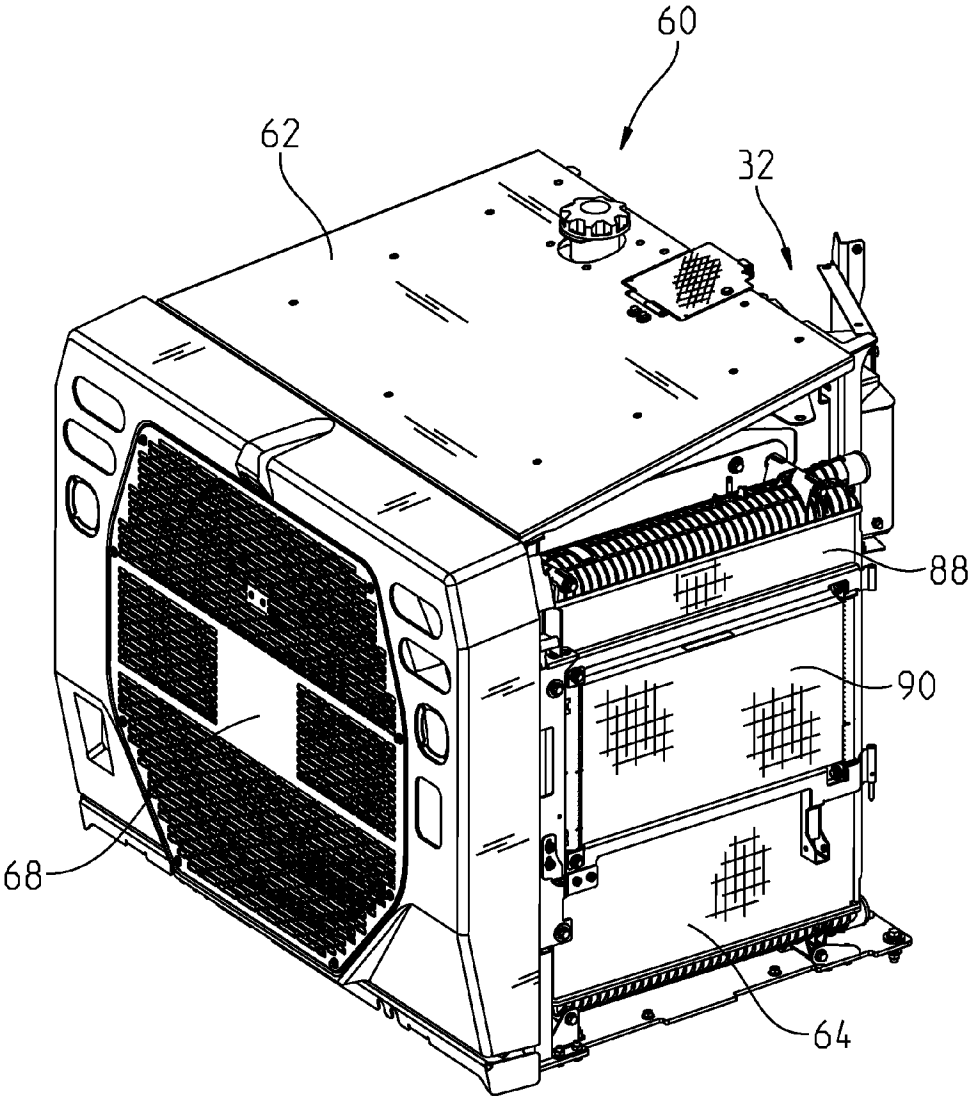
FIG. 8 is a right rear perspective view of the cooling system of FIG. 2.

As shown in FIG. 8, a right side of cooling system 60 includes a fifth heat exchanger 88, illustratively an engine cooler (e.g., a radiator), and a sixth heat exchanger 90, illustratively an air conditioner condenser. Heat exchangers 88, 90 may be configured to rotate to facilitate cleaning and repair. For example, sixth heat exchanger 90 may be in a stacked arrangement with, and rotatably coupled to, fifth heat exchanger 88, such that sixth heat exchanger 90 pivots or rotates away from fifth heat exchanger 88.

Referring to FIG. 3, a door 92 extends along the left side of cooling system 60 and covers heat exchangers 80, 82, 84, and 86 when in locked in a closed position via a latch assembly 97. Door 92 covering heat exchangers 80, 82, 84, and 86 is rearward of door 48 covering batteries 30 and is configured to open to expose heat exchangers 80, 82, 84, and 86 when pivoted in a generally horizontal plane, as shown in FIG. 4, or rotated upwardly or downwardly in a generally vertical plane (not shown). Door 92 includes a vent or screen 93 that transmits ambient air to heat exchangers 80, 82, 84, and 86. Opposite door 92, and shown in FIG. 2, another door 94 extends along the right side of cooling system 60 adjacent fifth and sixth heat exchangers 88 and 90, respectively. Door 94 includes a latch assembly 99 to lock and unlock door 94. Door 94 also may pivot in a generally horizontal plane, as shown in FIG. 4, or rotate upwardly or downwardly in a generally vertical plane (not shown) to expose fifth and sixth heat exchangers 88, 90. Door 94 also has a vent or screen 95 to flow ambient air to heat exchangers 88, 90.

Figure 9:
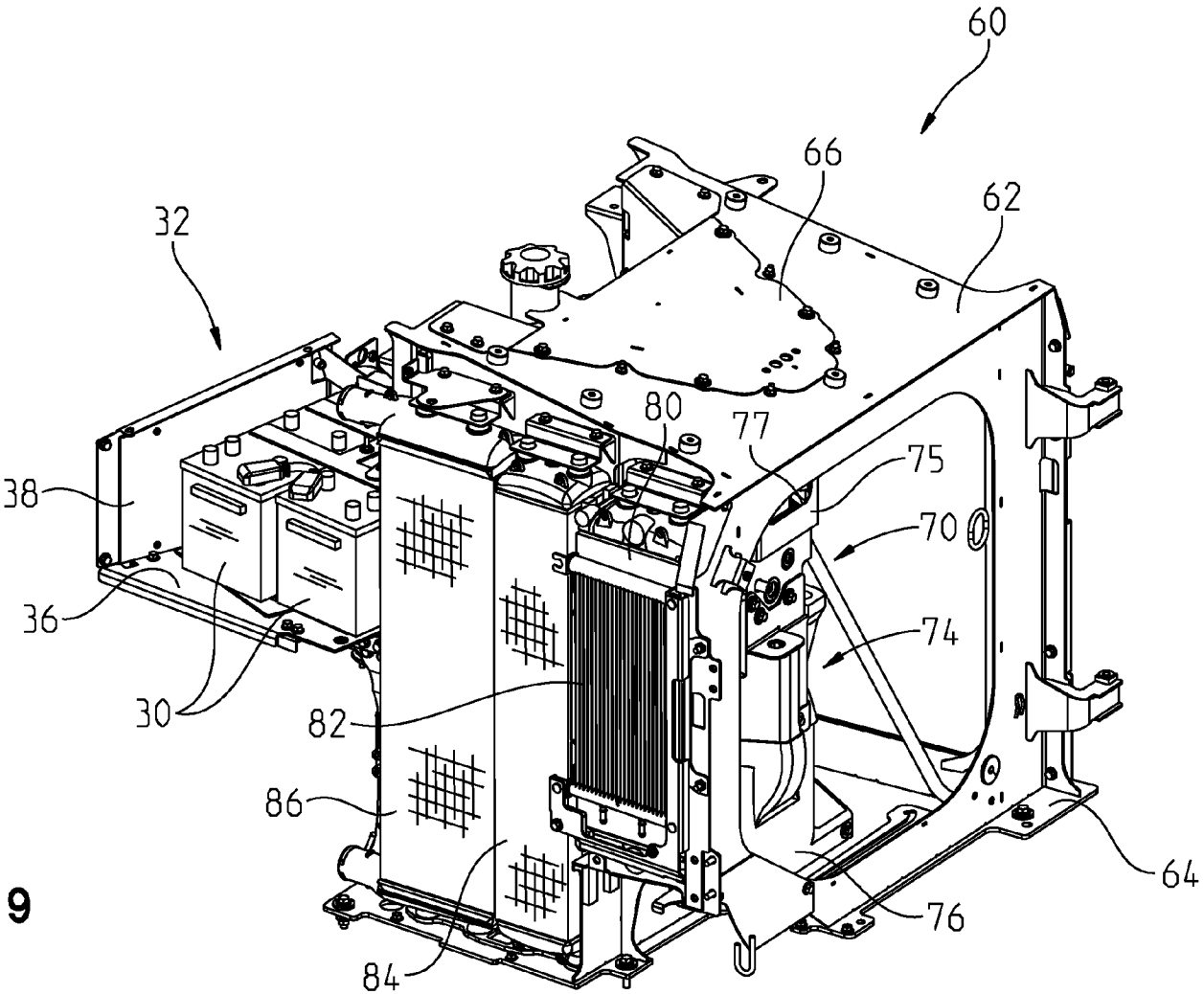
FIG. 9 is a left rear perspective view of the cooling system of FIG. 4, shown with the doors and fan removed.
Figure 10:
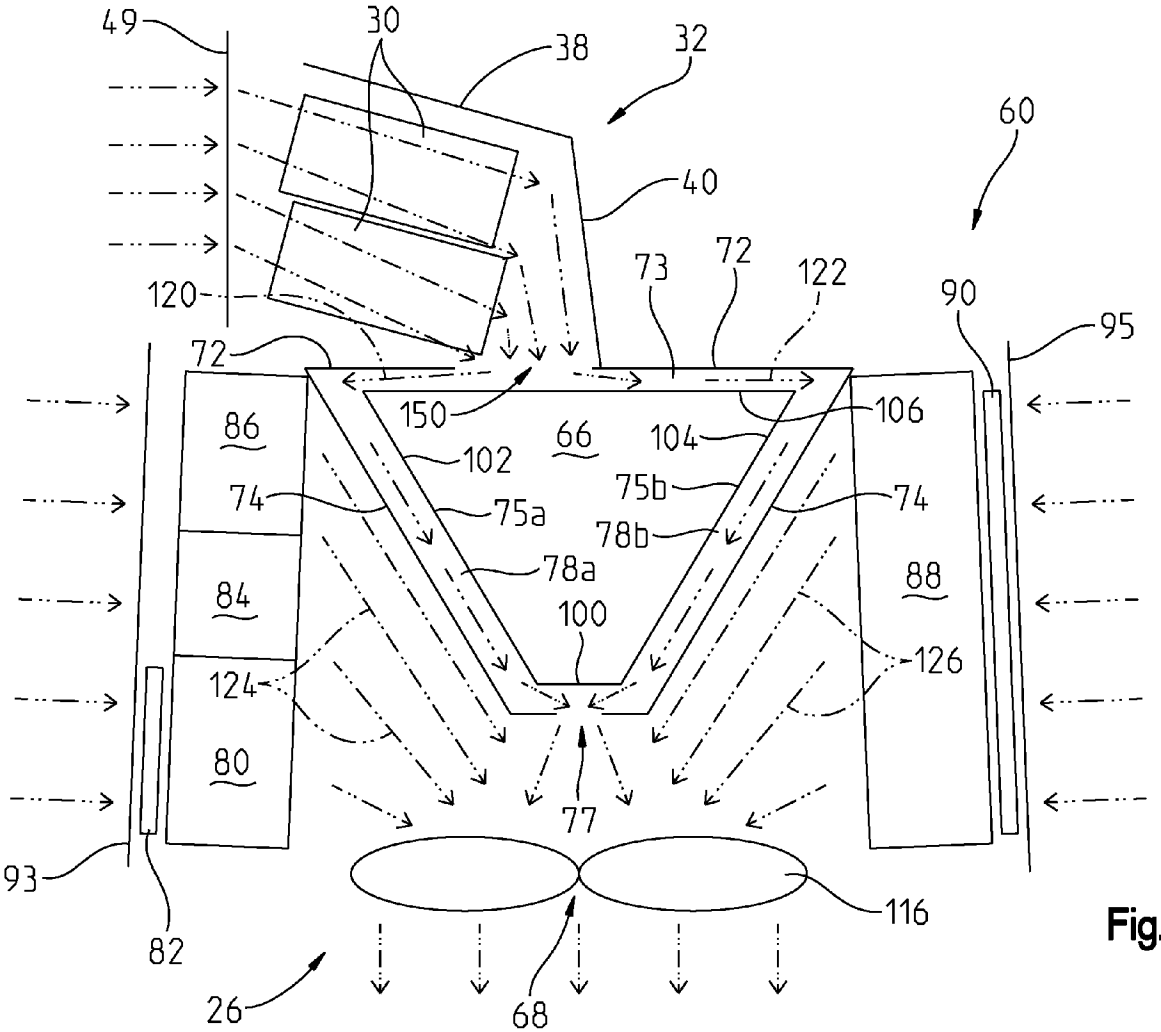
FIG. 10 is a schematic view of the cooling system, indicating the flow of air through the cooling system.
Figure 11:
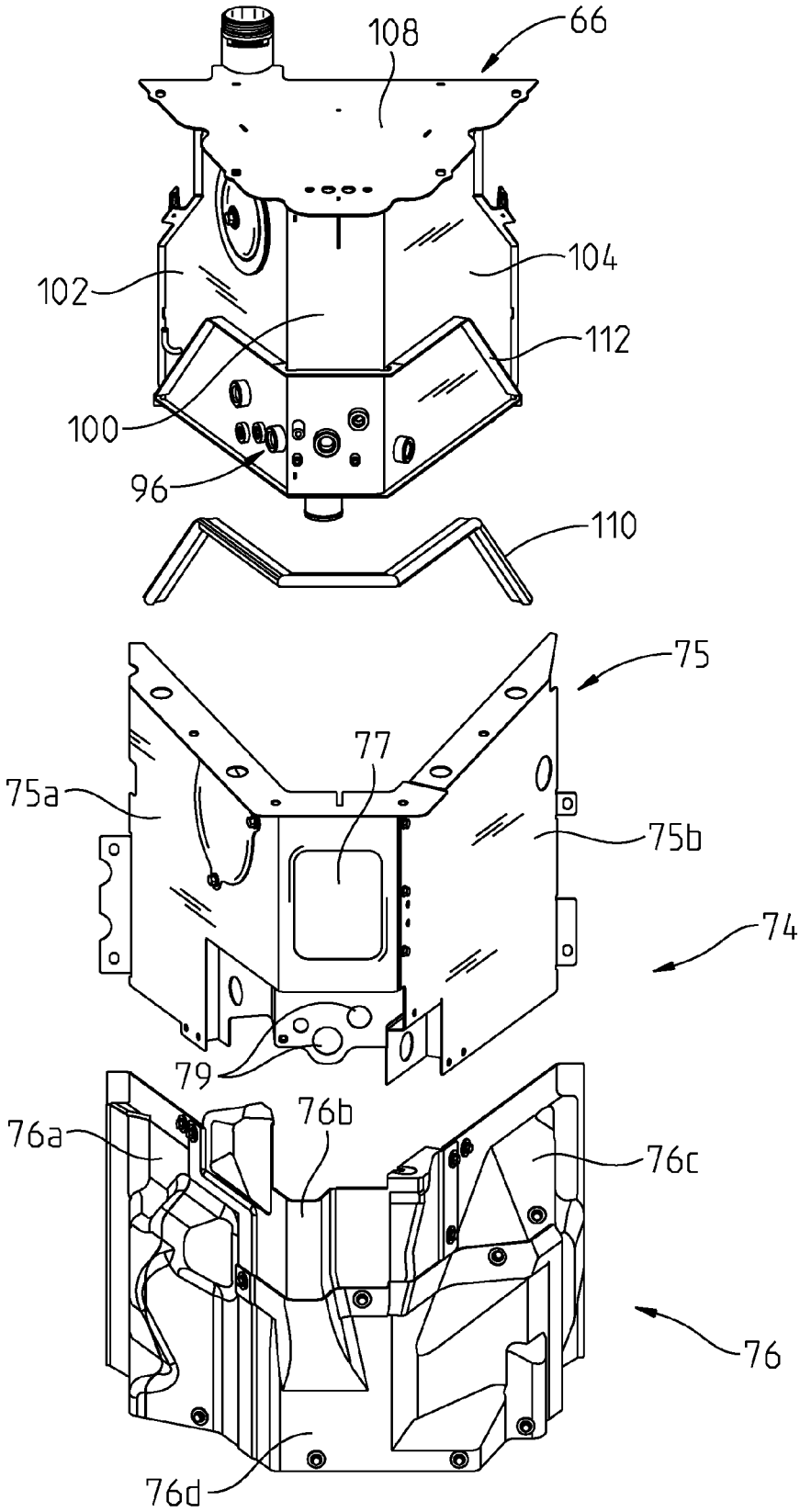
FIG. 11 is an exploded view of the fluid reservoir and a baffle assembly of the cooling system of FIG. 6.

As shown in FIGS. 9-11, fluid reservoir 66 is positioned rearward of engine 14 and is positioned intermediate left-side heat exchangers 80, 82, 84, and 86, and right-side heat exchangers 88 and 90. Additionally, fluid reservoir 66 may be positioned above at least a portion of transmission 16 and a plurality of pumps (not shown). Illustrative fluid reservoir 66 is coupled to upper support plate 62 of the frame of cooling system 60 with conventional fasteners, such as bolts, nails, or welds. Referring to FIGS. 10 and 11, fluid reservoir 66 may have a generally triangular or quadrilateral shape and, illustratively, includes a rear wall 100, opposing side walls 102, 104, a front wall 106, an upper wall 108, and a lower wall (not shown). The width of rear wall 100 is substantially less than the width of front wall 106 such that fluid reservoir 66 is generally V-shaped. As such, fluid reservoir 66 contributes to the compact arrangement of cooling system 60. Therefore, cooling system 60 does not obstruct the line of sight of the operator. Furthermore, the compact configuration of cooling system 60 allows more space in engine compartment 28 to be used for other components of grader 10, for example emissions-compliant components.

Referring to FIG. 6, illustrative fluid reservoir 66 is a hydraulic tank that stores hydraulic fluid for grader 10. Fluid reservoir 66 may be in fluid communication with various components of grader 10 through a plurality of fluid ports 96 that couple with a plurality of hoses and/or pumps (not shown).

Cooling system 60 is configured to flow air around fluid reservoir 66 in order to decrease the temperature of the reservoir fluid and prevent overheating, as is further detailed herein. As shown in FIG. 11, fluid reservoir 66 may be coupled to a sealing member 110 that further facilitates fluid cooling by preventing hot air in engine compartment 28 from flowing around fluid reservoir 66. More particularly, sealing member 110 is coupled to a protrusion 112 on fluid reservoir 66 which extends between side walls 102 and 104, and along rear wall 100 of fluid reservoir 66. Sealing member 112 cooperates with baffle assembly 70 to define a seal or barrier between engine compartment 28 and the ambient air in cooling system 60.

Figure 12:
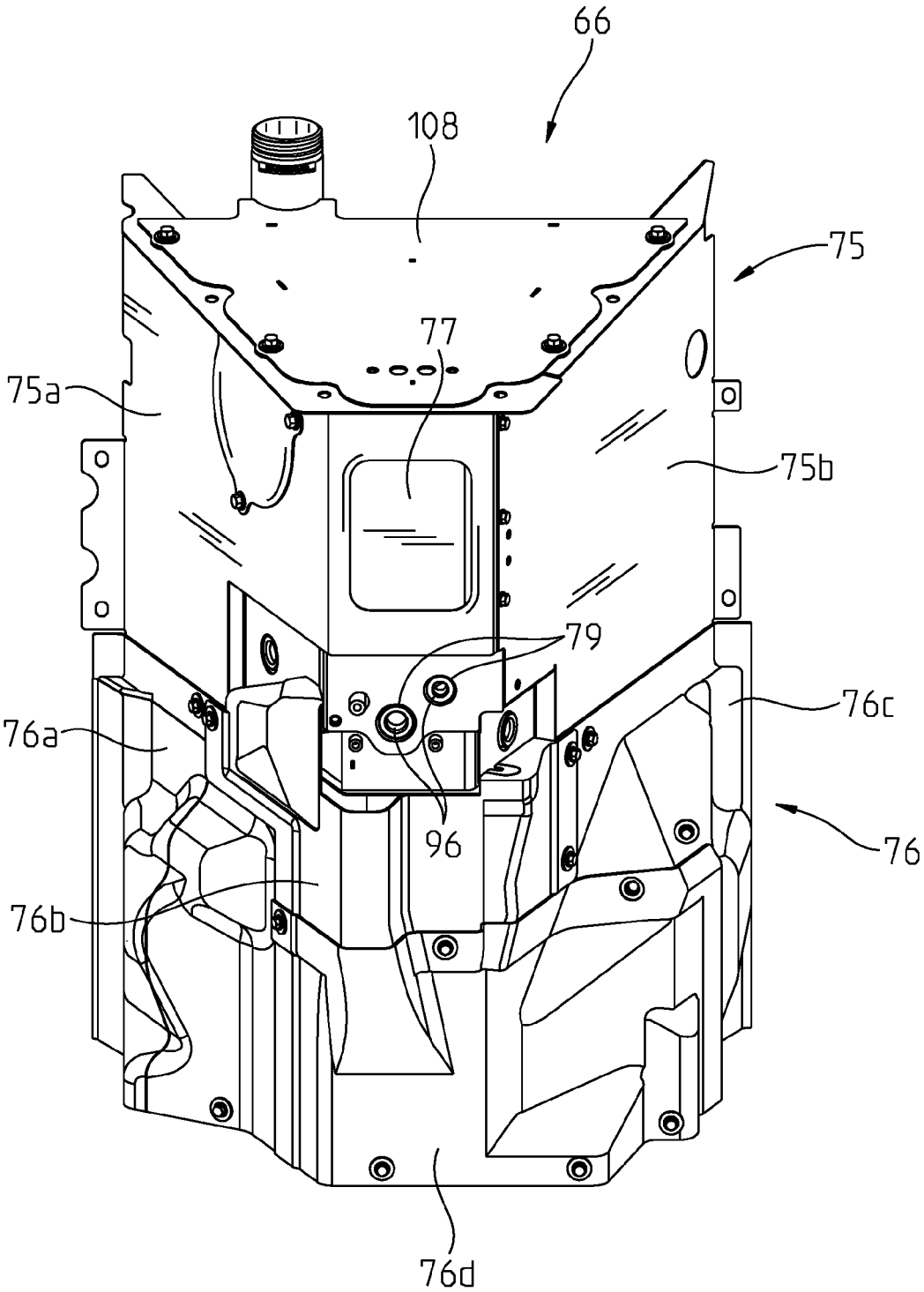
FIG. 12 is an assembled, rear perspective view of the fluid reservoir and baffle assembly of FIG. 11.

Referring now to FIGS. 10-12, baffle assembly 70 forms a separate component of cooling system 60 that generally surrounds fluid reservoir 66 but is spaced apart therefrom. In particular, baffle assembly 70 includes a front baffle 72 and a rear baffle assembly 74. Front baffle 72 forms a generally flat plate adjacent front wall 106 of fluid reservoir 66 and batteries 30. More particularly, front baffle 72 is spaced apart from fluid reservoir 66 to define a front channel 73. As shown in FIGS. 7 and 10, front baffle 72 includes a generally rectangular opening 150 adjacent a rear portion of batteries 30 and inner wall 40. Opening 150 provides access to front channel 73 around fluid reservoir 66 from battery housing 32. Additionally, other components within engine compartment 28, for example pumps and surge tanks, may be placed in front of baffle assembly 70 such that opening 150 provides access to front channel 73 from those components.

Rear baffle assembly 74 extends between front baffle 72 and fan 68, and may be coupled to upper support plate 62 and lower support plate 64, as shown in FIG. 9. Illustrative rear baffle assembly 74 includes a first or upper baffle 75 coupled to a second or lower baffle 76, however, rear baffle assembly 74 may be formed as a unitary component or may be comprised of more than two baffles. As shown in FIGS. 10-12, rear baffle assembly 74 has a shape similar to that of fluid reservoir 66 and is spaced apart from an outer surface of fluid reservoir 66 to define a first side channel 78*a* and a side second channel 78*b* (see FIG. 10). Channels 78*a*, 78*b* are angled relative to channel 73, such that channels 73, 78*a*, 78*b* form a triangular fluid passageway.

Referring to FIG. 11, the illustrative embodiment of rear upper baffle 75 includes at least a first side 75*a* coupled to a second side 75*b*. For example, first side 75*a* extends along side wall 102 and rear wall 100 of fluid reservoir 66 to define first side channel 78*a*. Similarly, second side 75*b* extends along opposing side wall 104 of fluid reservoir 66 to define second side channel 78*b*. Rear upper baffle 75 includes a generally rectangular opening 77 rearward of rear wall 100 of fluid reservoir 66 and centered on rear upper baffle 75. Rear lower baffle 76 does not cover or otherwise obstruct opening 77, but rather, may be positioned below opening 77.

Opening 77 provides fluid access to fan 68 from channels 73, 78*a*, 78*b*. Rear upper baffle 75 also may include a plurality of apertures 79 for exposing ports 96 of fluid reservoir 66.

As shown in FIGS. 11 and 12, illustrative rear lower baffle 76 includes at least a first portion 76*a*, a second portion 76*b*, a third portion 76*c*, and a fourth portion 76*d*. Second portion 76*b* may be coupled to first, third, and fourth portions 76*a*, 76*c*, and 76*d* with conventional fasteners (e.g., bolts). Additionally, first, second, and third portions 76*a*, 76*b*, and 76*c* are coupled to rear upper baffle 75 with conventional fasteners. Fourth portion 76*d* may be coupled to lower support plate 64 of cooling system 60 (FIG. 9).

Rear upper baffle 75 cooperates with sealing member 110 to create a complete plenum around fluid reservoir 66 and to prevent hot air in engine compartment 28 from entering channels 73, 78*a*, and 78*b*, as is further detailed herein. The illustrative embodiment of rear upper baffle 75 presses against sealing member 110 to retain hot air in engine compartment 28 and below fluid reservoir 66. More particularly, sealing member 110 forms an upper limit for the air within engine compartment 28 and, as such, the air from engine compartment 28 is kept below fluid reservoir 66 and does not flow above sealing member 110. It may be appreciated that protrusion 112 defines the space between rear upper baffle 75 and fluid reservoir 66, and thereby defines channels 78*a*, 78*b*.

Figure 13:
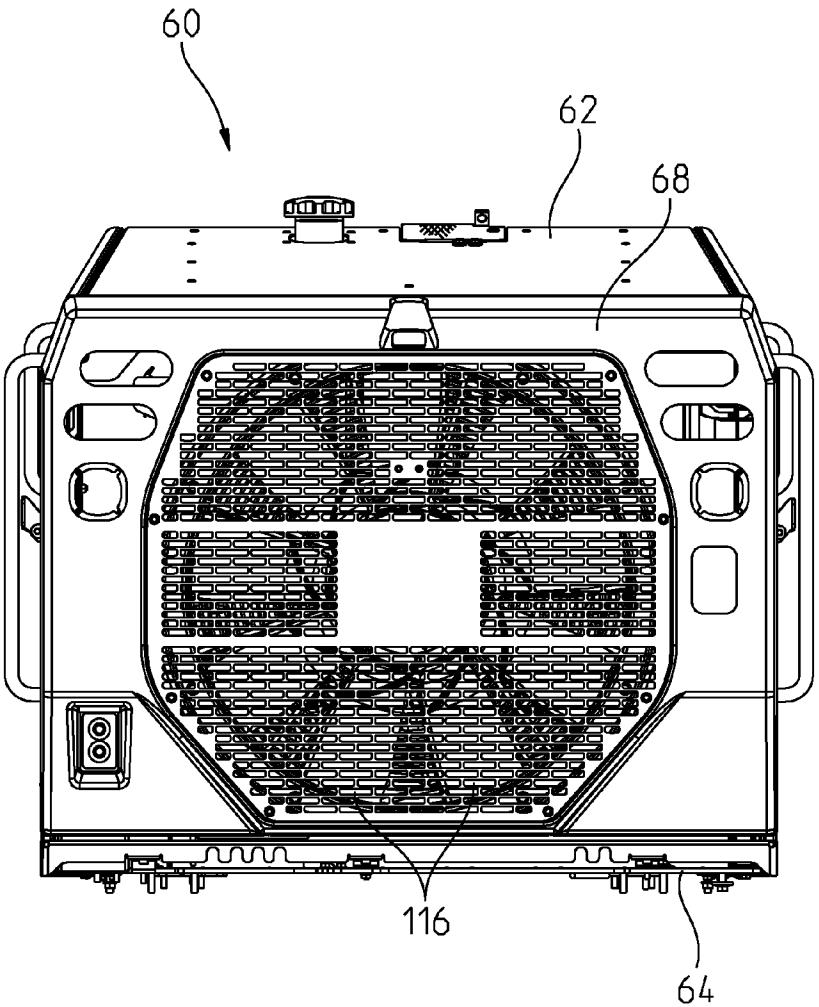
FIG. 13 is a rear elevational view of the cooling system of FIG. 2.

With reference to FIG. 13, cooling system 60 includes an air propelling mechanism, illustratively fan 68. Alternative embodiments of cooling system 60 may include other blowers, vent systems, or air flow devices. Fan 68 is positioned rearward of engine compartment 28 and rearward of fluid reservoir 66. Fan 68 may be configured to rotate or pivot to an open position for servicing and cleaning, and for accessing other components of cooling system 60. For example, as shown in FIG. 4, fan 68 pivots in the direction of arrow 114 to the open position. As is detailed herein, fan 68 is configured to both draw ambient air into cooling system 60 and draw hot air from cooling system 60. In particular, illustrative fan 68 includes rotating fan blades 116 which draw hot air from cooling system 60 rearwardly and away from engine compartment 28 and grader 10.

In operation, cooling system 60 decreases the temperature of the fluids in fluid reservoir 66 and heat exchangers 80, 82, 84, 86, 88, and 90. Additionally, cooling system 60 decreases the temperature of other components of grader 10, for example batteries 30, pumps, and/or surge tanks Illustrative cooling system 60 simultaneously flows ambient air over batteries 30 and heat exchangers 80, 82, 84, 86, 88, and 90, and may have an overall air flow rate of approximately 16,000 cfm ($ft^3$/min). During operation of grader 10, blades 116 of fan 68 rotate to draw ambient air inwardly through screen 49 of door 48 and through screens 93, 95 of doors 92, 94, respectively. With respect to batteries 30 of FIG. 10, fan 68 draws air through screen 49 and into battery housing 32, such that ambient air flows around batteries 30 and decreases the temperature of batteries 30. In particular, ambient air is directed in a generally clockwise direction around batteries 30, i.e., air flows along front wall 38 and inner wall 40. Furthermore, spacers 46 allow ambient air to flow through channels 50 underneath batteries 30 (e.g., between plate 44 and lower wall 36). The flow of air around and under batteries 30 has a cooling effect to maintain the temperature of illustrative batteries 30 at less than approximately 60° C. Alternatively, the temperature of batteries 30 may be maintained at temperatures greater than approximately 60° C. Housing 32 may further include mounting portion 140 (FIG. 14) for an electric fan (not shown) to further decrease the operating temperature of batteries 30. Cooling system 60 may also cool other components in grader 10 within engine compartment 28 (e.g., pumps, surge tanks) in a manner similar to that described for batteries 30 when the operating temperatures of those components also should be less than that of engine compartment 28.

In order to maintain the temperature of batteries 30 without drawing too much ambient air away from heat exchangers 80, 82, 84, 86, 88, and 90, the size of screen 49 may be limited relative to screens 93, 95. As such, the air flow through screen 49 that enters housing 32 and cools batteries 30 may be approximately 400 cfm. In comparison, the larger screens 93, 95 may allow for exemplary air flow rates of approximately 300-1800 cfm through first heat exchanger 80, approximately 1200 cfm through second heat exchanger 82, approximately 2100 cfm through third heat exchanger 84, approximately 2500 cfm through fourth heat exchanger 86, approximately 9500 cfm through fifth heat exchanger 88, and approximately 3100 cfm through sixth heat exchanger 90.

After ambient air decreases the operating temperature of batteries 30, the air flows through opening 150 in front baffle 72 and into front channel 73 to cool fluid reservoir 66. As shown in FIG. 10, air from housing 32 flows into front channel 73 and is divided into two separate streams. In particular, one stream of air flows in the direction of arrows 120 toward the left side of grader 10 and is directed rearwardly through side channel 78*a* towards fan 68. The other stream of air flows in the direction of arrows 122 toward the right side of grader 10 and is directed rearwardly through side channel 78*b* towards fan 68. Both streams of air exit side channels 78*a*, 78*b* through opening 77 of rear upper baffle 75. As such, rear upper baffle 75 directs air from housing 32 around fluid reservoir 66 to provide a cooling effect.

An example of the cooling effect of illustrative cooling system 60 is detailed herein. The temperature of the ambient air housing 32 was assumed to be approximately 20° C.

However, due to the heat generated by batteries 30, the temperature of the ambient air increases after entering housing 32 and may be greater than approximately 20° C. and less than approximately 47° C. when flowing through opening 150 and channels 73, 78*a*, 78*b*. After the air flows through channels 78*a*, 78*b*, the temperature of the air may be increased due to the heat transferred from fluid reservoir 66, and may be at least approximately 47° C. when exiting channels 78*a*, 78*b* via opening 77. However, because the temperature of fluid reservoir 66 may be approximately 80° C., the temperature of the air flowing through channels 73, 78*a*, 78*b* is less than the temperature of fluid reservoir 66. As such, the air in channels 73, 78*a*, 78*b* has a cooling effect on fluid reservoir 66. The cooling effect is the additional amount of cooling gained for fluid reservoir 66 by using baffle assembly 70 to flow air through channels 73, 78*a*, 78*b* to cool fluid reservoir 66, rather than cooling fluid reservoir 66 with air that flows through heat exchangers 80, 82, 84, 86, 88, and 90 if baffle assembly 70 was not present. Heat rejection calculations indicate that the cooling effect on fluid reservoir 66 is approximately 0.34° C. As such, the cooling achieved for fluid reservoir 66 may be increased by 0.34° C. when using air from housing 32 and in channels 73, 78*a*, 78*b* to cool fluid reservoir 66, rather than using air from heat exchangers 80, 82, 84, 86, 88, and 90, which would flow around fluid reservoir 66 if baffle assembly 70 was not utilized. Alternative embodiments of fluid reservoir 66 may include fins (not shown) to further increase the cooling effect.

In addition to entering screen 49, ambient air also enters screens 93, 95 and flows into cooling system 60 through heat exchangers 80, 82, 84, 86, 88, and 90. As shown in FIG. 10, ambient air enters cooling system 60 in a direction generally perpendicular to heat exchangers 80, 82, 84, 86, 88, and 90. Then, the air deviates toward rear end 26 of grader 10. More particularly, ambient air exiting heat exchangers 80, 82, 84, and 86 from the left side of grader 10 flows in the direction of arrows 124 along side 75*a* of rear upper baffle 75. Ambient air entering heat exchangers 88 and 90 from the right side of grader 10 flows in the direction of arrows 126 along side 75*b* of rear upper baffle 75. The air flowing from heat exchangers 80, 82, 84, 86 in the direction of arrows 124, the air flowing from heat exchangers 88, 90 in the direction of arrows 126, and the air exiting channels 78*a*, 78*b* through opening 77 mixes in front of fan 68 and is collectively exhausted from grader 10 through fan 68. It may be appreciated that without baffle assembly 70, the air through heat exchangers 80, 82, 84, 86, 88, and 90 also would flow along side walls 102, 104 of fluid reservoir 66 which, because the air is warmed by heat exchangers 80, 82, 84, 86, 88, and 90, may decrease the cooling effect on fluid reservoir 66. Therefore, by using a first stream of air to cool fluid reservoir and a separate second stream of air to cool heat exchangers 80, 82, 84, 86, 88, and 90, the cooling effect on fluid reservoir 66 may be increased.

Additionally, rear lower baffle 76 cooperates with sealing member 110 to create a complete plenum below fluid reservoir 66. Therefore, the coupling of rear lower baffle 76 and sealing member 110 does not allow hot air in engine compartment 28 to be drawn upwardly through channels 73, 78*a*, 78*b*, through heat exchangers 80, 82, 84, 86, 88, and 90, or through fan 68. Rather, the air flowing through channels 73, 78*a*, 78*b* and heat exchangers 80, 82, 84, 86, 88, and 90 is ambient air, or ambient air that has been somewhat heated therein, is clean and still cooler than the temperature of engine compartment 28, fluid reservoir 66, batteries 30, and heat exchangers 80, 82, 84, 86, 88, and 90. In this way, cooling system 60 operates to efficiently cool the various fluids and components of grader 10. The efficient operation of cooling system 60 promotes lower speeds for fan 68, which increase fuel efficiency and decrease noise.

Figure 15:
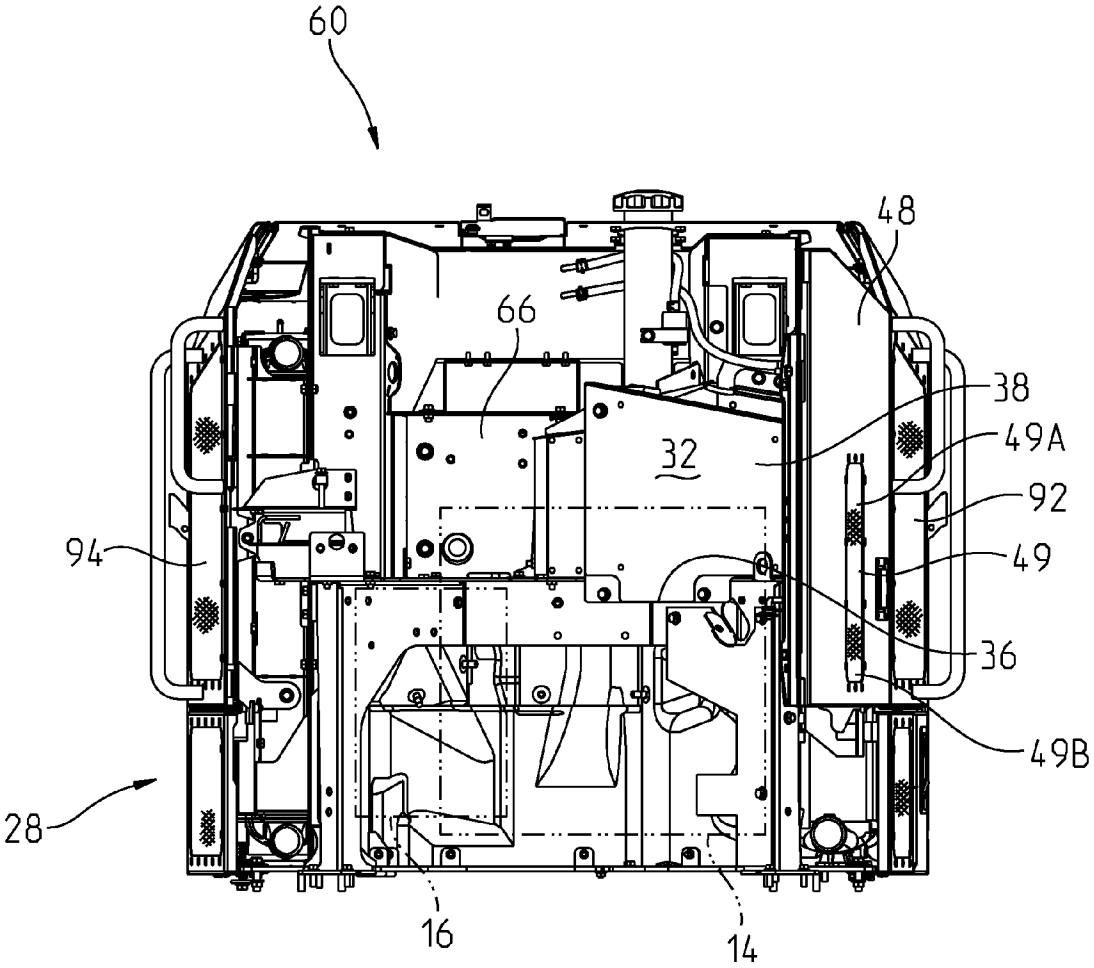
FIG. 15 is a front elevational view of the engine compartment and the cooling system of the present disclosure.

Additionally, using computational fluid dynamics ("CFD"), the size and position of screen 49 is optimized to allow hot air from engine compartment 28 to flow from grader 10 through screen 49. For example, as shown in FIG. 15, screen 49 includes an upper portion 49A adjacent batteries 30 and housing 32, and a lower portion 49B that extends below housing 32 so as to be adjacent to other components within engine compartment 28 (e.g., the DEF module and the circuit breakers). More particularly, screen 49 is sized and positioned to allow hot air generated by the DEF module and the circuit breaker below housing 32 to flow out of engine compartment 28 and through lower portion 49B of screen 49. However, the size of lower portion 49B may be minimized to limit hot air in engine compartment 28 from flowing upwardly and entering housing 32 through upper portion 49A of screen 49. Also, screen 49 is positioned adjacent to the other components below batteries 30 to encourage hot air from engine compartment 28 and outside of housing 32 to exit grader 10, while limiting a direct path from engine compartment 28 to batteries 30. Illustrative screen 49 is less than 25 mm from lower wall 36 and batteries 30 in order to prevent hot air below batteries 30 from entering housing 32 and overheating batteries 30.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A vehicle including:
- a chassis;
- a plurality of ground-engaging members;
- an engine cooperating with the plurality of ground-engaging members to move the chassis of the vehicle, the engine being positioned within an engine compartment; and
- a cooling system including:
  - a baffle having a first side and a second side;
  - a battery positioned on the first side of the baffle;
  - a heat exchanger positioned on the second side of the baffle, the baffle defining a first air pathway to cool the battery and a second air pathway to cool the heat exchanger;
  - a fluid reservoir positioned rearward of the engine; and
  - a fan positioned rearward of the fluid reservoir and configured to direct air away from the engine compartment.

2. The vehicle of claim 1, wherein the fluid reservoir is substantially V-shaped.

3. The vehicle of claim 1, wherein the cooling system is configured to decrease an operating temperature of the at least one battery and the fluid reservoir.

4. The vehicle of claim 1, wherein the first air pathway intersects the second air pathway.

5. A vehicle including:
- a chassis;
- a plurality of ground-engaging members;
- an engine cooperating with the plurality of ground-engaging members to move the chassis of the vehicle;
- a cooling system including:
  - a fluid reservoir; and
  - a baffle assembly generally positioned around the fluid reservoir and spaced apart from the fluid reservoir, an inner surface of the baffle assembly cooperating with an outer surface of the fluid reservoir to define a channel, and the cooling system being configured to direct air from outside the vehicle through the channel.

6. The vehicle of claim 5, wherein the baffle assembly is comprised of a first portion and a second portion, the first portion is forward of the fluid reservoir and the second portion is rearward of the fluid reservoir.

7. The vehicle of claim 5, wherein a first flow of air is directed through the channel and a second flow of air is directed along an outer surface of the baffle assembly.

8. The vehicle of claim 7, further comprising a fan rearward of the baffle assembly, wherein the first flow of air mixes with the second flow of air in front of the fan.

9. The vehicle of claim 7, wherein the fan directs air within the cooling system away from the engine.

10. The vehicle of claim 5, wherein a shape of the baffle assembly is generally complementary to a shape of the fluid reservoir.

11. The vehicle of claim 5, wherein the baffle assembly defines an interior region and the fluid reservoir is positioned within the interior region of the baffle assembly.

12. A vehicle including:

a chassis;

a plurality of ground-engaging members;

an engine positioned within an engine compartment supported by the chassis and operatively coupled to the ground-engaging members;

at least one battery spaced apart from the engine;

a cooling system including:

a fluid reservoir;

a baffle spaced apart from the fluid reservoir;

a heat exchanger spaced apart from the baffle; and a fan spaced apart from the baffle, the cooling system being configured to direct a first flow of air around the battery and along an inner surface of the baffle, and a second flow of air through the heat exchanger and along an outer surface of the baffle.

13. The vehicle of claim 12, wherein the first and second flows of air mix together in a rear portion of the cooling system.

14. The vehicle of claim 12, further comprising a sealing member coupled to the fluid reservoir and separating the first and second flows of air from the engine compartment.

15. The vehicle of claim 12, wherein the cooling system provides a cooling effect to the fluid reservoir of approximately 0.34° C.

16. The vehicle of claim 12, wherein the fan is positioned rearward of the fluid reservoir, and is configured to exhaust the first and second flows of air from the vehicle.

17. A vehicle including:

a chassis;

a plurality of ground-engaging members;

an engine positioned within an engine compartment supported by the chassis and operatively coupled to the plurality of ground-engaging members;

a battery compartment positioned within the engine compartment; and a cooling system positioned rearwardly of the engine and including:

a fluid reservoir;

a baffle assembly spaced apart from the fluid reservoir and configured to block air flow from around the engine to the fluid reservoir;

a heat exchanger positioned laterally outward from the baffle assembly; and a fan configured to draw air from the battery compartment rearwardly through the baffle assembly.

18. The vehicle of claim 17, wherein the battery compartment includes at least one battery and a plurality of spacing members positioned below the at least one battery to elevate the at least one battery in the battery compartment.

19. The vehicle of claim 18, wherein the cooling system draws air into the battery compartment and below the at least one battery to decrease an operating temperature of the at least one battery.

20. The vehicle of claim 18, wherein the spacing members are comprised of a non-conductive material.

21. The vehicle of claim 17, wherein the battery compartment includes a reflective member configured to reflect radiant heat from the engine compartment away from at least one battery.

22. The vehicle of claim 17, wherein the cooling system is configured to provide a first flow of air to the battery compartment, and a second flow of air to the heat exchanger.

23. The vehicle of claim 17, wherein the baffle assembly includes a first portion having an opening and a second portion coupled to the first portion, the fan is positioned rearward of the baffle assembly and is configured to draw air from the battery compartment through the opening of the first portion of the baffle assembly.

* * * * *